US010107532B2

(12) United States Patent
Baba

(10) Patent No.: US 10,107,532 B2
(45) Date of Patent: Oct. 23, 2018

(54) REFRIGERANT EVAPORATOR HAVING A TANK EXTERNAL REFRIGERANT SPACE

(71) Applicant: DENSO CORPORATION, Kariya, Aichi-pref. (JP)

(72) Inventor: Norimasa Baba, Toyoake (JP)

(73) Assignee: DENSO CORPORATION, Kariya, Aichi-pref. (JP)

( * ) Notice: Subject to any disclaimer, the term of this patent is extended or adjusted under 35 U.S.C. 154(b) by 327 days.

(21) Appl. No.: 14/893,434

(22) PCT Filed: May 16, 2014

(86) PCT No.: PCT/JP2014/002591

§ 371 (c)(1),
(2) Date: Nov. 23, 2015

(87) PCT Pub. No.: WO2014/188690

PCT Pub. Date: Nov. 27, 2014

(65) Prior Publication Data

US 2016/0109168 A1 Apr. 21, 2016

(30) Foreign Application Priority Data

May 24, 2013 (JP) ..... 2013-110057

(51) Int. Cl.
*F25B 39/02* (2006.01)
*F25B 39/00* (2006.01)
(Continued)

(52) U.S. Cl.
CPC ..... *F25B 39/00* (2013.01); *F25B 39/02* (2013.01); *F28D 1/05391* (2013.01);
(Continued)

(58) Field of Classification Search
CPC ..... F25B 39/00; F28F 9/0265; F28F 9/0212; F28F 2009/0285; F28F 2009/029; F28F 9/0268; F28D 1/05391
See application file for complete search history.

(56) References Cited

U.S. PATENT DOCUMENTS

2004/0206490 A1 10/2004 Katoh et al.
2005/0235691 A1 10/2005 Katoh et al.
(Continued)

FOREIGN PATENT DOCUMENTS

JP H03064359 U 6/1991
JP 2005195316 A 7/2005
(Continued)

OTHER PUBLICATIONS

U.S. Appl. No. 14/890,689, filed Nov. 12, 2015, Ishizaka et al.
(Continued)

*Primary Examiner* — Frantz Jules
*Assistant Examiner* — Steve Tanenbaum
(74) *Attorney, Agent, or Firm* — Harness, Dickey & Pierce, P.L.C.

(57) ABSTRACT

A refrigerant evaporator includes a first evaporation unit and a second evaporation unit disposed in series in a flow direction of fluid to be cooled by evaporating refrigerant. An intermediate tank portion through which refrigerant flows is connected to an outer surface of one tank portion of the first evaporation unit and an outer surface of one tank portion of the second evaporation unit. A tank external refrigerant space through which refrigerant flows is defined by an outer wall of the one tank portion of the first evaporation unit, an outer wall of the one tank portion of the second evaporation unit, and an outer wall of the intermediate tank portion.

15 Claims, 7 Drawing Sheets

(51) Int. Cl.

| | |
|---|---|
| ***F28F 9/02*** | (2006.01) |
| ***F28D 1/053*** | (2006.01) |
| *F28D 21/00* | (2006.01) |

(52) U.S. Cl.
CPC ..... *F28F 9/0212* (2013.01); *F28F 9/0265* (2013.01); *F28D 2021/0071* (2013.01); *F28D 2021/0085* (2013.01); *F28F 2009/029* (2013.01); *F28F 2009/0285* (2013.01)

(56) References Cited

U.S. PATENT DOCUMENTS

| | | | | |
|---|---|---|---|---|
| 2007/0074861 | A1 | 4/2007 | Higashiyama | |
| 2011/0259042 | A1* | 10/2011 | Nishino | F28D 1/0333 62/527 |
| 2013/0312453 | A1* | 11/2013 | Jeon | F25B 39/028 62/524 |
| 2013/0312454 | A1* | 11/2013 | Jeon | F25B 39/028 62/524 |
| 2013/0312455 | A1* | 11/2013 | Jeon | F28D 1/0435 62/525 |

FOREIGN PATENT DOCUMENTS

| | | | |
|---|---|---|---|
| JP | 2005207716 | A | 8/2005 |
| JP | 2005299981 | A | 10/2005 |
| JP | 2006029697 | A | 2/2006 |
| JP | 4024095 | B2 | 12/2007 |
| JP | 2013096653 | A | 5/2013 |

OTHER PUBLICATIONS

U.S. Appl. No. 14/889,504, filed Nov. 6, 2015, Ishizaka.
International Search Report and Written Opinion (in Japanese with English Translation) for PCT/JP2014/002591, dated Aug. 12, 2014; ISA/JP.

* cited by examiner

REFRIGERANT EVAPORATOR HAVING A TANK EXTERNAL REFRIGERANT SPACE

CROSS REFERENCE TO RELATED APPLICATIONS

This application is a U.S. National Phase Application under 35 U.S.C. 371 of International Application No. PCT/JP2014/002591 filed on May 16, 2014 and published in Japanese as WO 2014/188690 A1 on Nov. 27, 2014. This application is based on and claims the benefit of priority from Japanese Patent Application No. 2013-110057 filed on May 24, 2013. The entire disclosures of all of the above applications are incorporated herein by reference.

TECHNICAL FIELD

The present disclosure relates to a refrigerant evaporator.

BACKGROUND ART

A refrigerant evaporator functions as a cooling heat exchanger that cools fluid (for example, air) flowing outside by evaporating refrigerant (liquid phase refrigerant) flowing inside to absorb heat from the fluid.

A refrigerant evaporator includes first and second evaporation units, each of which has a heat-exchanging core portion formed by stacking multiple tubes and a pair of tank portions connected to both ends of the multiple tubes. The first and second evaporation units are disposed in series in a flow direction of the fluid, and first tank portions of the respective evaporation units are coupled to each other via communication portions (see, for example, PTL 1).

The refrigerant evaporator of PTL 1 is configured in such a manner that when refrigerant that has flowed the heat-exchanging core portion of the first evaporation unit is made to flow into the heat-exchanging core portion of the second evaporation unit via the first tank portions of the respective evaporation units and a pair of the communication portions coupling the first tank portions, flows of the refrigerant are interchanged in a width direction (right-left direction) of the heat-exchanging core portions. In other words, the refrigerant evaporator is configured in such a manner that the refrigerant flowing the heat-exchanging core portion of the first evaporation unit on one side in the width direction is made to flow into the heat-exchanging core portion of the second evaporator portion on the other side in the width direction using one of the pair of communication portions, while the refrigerant flowing the heat-exchanging core portion of the first evaporation unit on the other side in the width direction is made to flow into the heat-exchanging core portion of the second evaporation unit on the one side in the width direction using the other communication portion.

In the refrigerant evaporator of PTL 1, the communication portions are formed by providing an intermediate tank portion to the first tank portions of the respective evaporation units and defining two refrigerant channels with a partition member disposed in the intermediate tank portion.

PRIOR ART LITERATURES

Patent Literature

JP 2005-207716 A

SUMMARY OF INVENTION

In the refrigerant evaporator of PTL 1, the partition member is bonded to an inner wall surface of the intermediate tank portion by, for example, brazing. Hence, in the event of poor brazing between the inner wall surface of the intermediate tank portion and the partition member, independence of the refrigerant channels in the intermediate tank portion can no longer be maintained. In this case, flows of the refrigerant may not be interchanged in the width direction (right-left direction) of the heat-exchanging core portions.

The present disclosure has an object to provide a refrigerant evaporator capable of interchanging flows of refrigerant in a width direction of heat-exchanging core portion in a reliable manner.

According to an aspect of the present disclosure, a refrigerant evaporator in which heat is exchanged between fluid flowing outside to be cooled and refrigerant includes a first evaporation unit and a second evaporation unit disposed in series in a flow direction of the fluid. Each of the first evaporation unit and the second evaporation unit has a heat-exchanging core portion in which a plurality of tubes are stacked, through which the refrigerant flows, and a pair of tank portions connected to both ends of the plurality of tubes to collect or distribute the refrigerant flowing through the plurality of tubes. The heat-exchanging core portion of the first evaporation unit has a first core portion defined by a part of the plurality of tubes and a second core portion defined by a rest of the plurality of tubes. The heat-exchanging core portion of the second evaporation unit has a third core portion defined by a part of the plurality of tubes opposing at least a part of the first core portion in the flow direction of the fluid and a fourth core portion defined by a part of the plurality of tubes opposing at least a part of the second core portion in the flow direction of the fluid. Of the pair of tank portions of the first evaporation unit, one tank portion includes a first refrigerant collection portion to collect the refrigerant from the first core portion and a second refrigerant collection portion to collect the refrigerant from the second core portion. Of the pair of tank portions of the second evaporation unit, one tank portion includes a first refrigerant distribution portion to distribute the refrigerant to the third core portion and a second refrigerant distribution portion to distribute the refrigerant to the fourth core portion. The first evaporation unit and the second evaporation unit are coupled via a first communication portion that introduces the refrigerant in the first refrigerant collection portion to the second refrigerant distribution portion and a second communication portion that introduces the refrigerant in the second refrigerant collection portion to the first refrigerant distribution portion. An intermediate tank portion through which refrigerant flows is connected to an outer surface of the one tank portion of the first evaporation unit and an outer surface of the one tank portion of the second evaporation unit. A tank external refrigerant space through which refrigerant flows is defined by an outer wall of the one tank portion of the first evaporation unit, an outer wall of the one tank portion of the second evaporation unit, and an outer wall of the intermediate tank portion. The intermediate tank portion defines the first communication portion and the tank external refrigerant space defines the second communication portion.

According to the refrigerant evaporator configured as above, the intermediate tank portion is provided as the first communication portion and the tank external refrigerant space defined by the outer wall of the one tank portion of the first evaporation unit, the outer wall of the one tank portion of the second evaporation unit, and the outer wall of the intermediate tank portion is provided as the second communication portion. Hence, the first communication portion and the second communication portion can be formed as refrigerant channels independent of each other. Consequently, flows of the refrigerant can be interchanged in a width direction of the heat-exchanging core portion, namely, a tube stacking direction, in a reliable manner.

DESCRIPTION OF EMBODIMENTS

Figure 1:
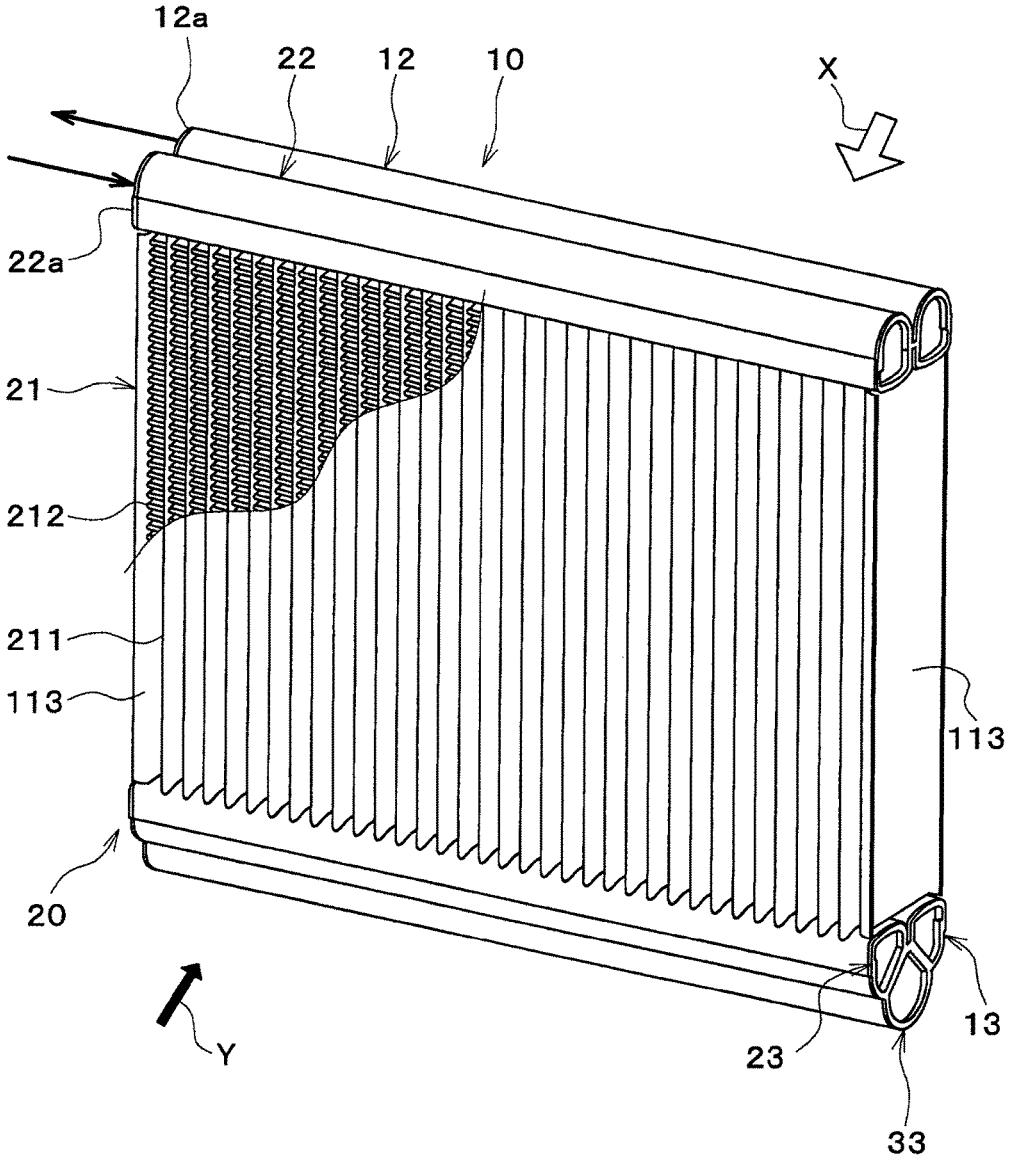
FIG. 1 is a perspective view of a refrigerant evaporator according to a first embodiment.

Embodiments of the present disclosure will be described according to the drawings. Hereinafter, same or equivalent portions among the respective embodiments will be labeled with same reference numerals.

First Embodiment

A first embodiment will be described using FIG. 1 through FIG. 6. A refrigerant evaporator 1 of the present embodiment is a cooling heat exchanger which is applied to a vapor compression refrigerating cycle in an air conditioner for a vehicle to adjust a temperature in the vehicle interior and cools blown air to be blown into the vehicle interior by absorbing heat from the blown air and letting refrigerant (liquid phase refrigerant) evaporate. In the present embodiment, the blown air corresponds to "a fluid flowing outside to be cooled".

The refrigerating cycle is known to include the refrigerant evaporator 1 as well as components unillustrated herein, such as a compressor, a radiator (condenser), and an expansion valve. In the present embodiment, the refrigerating cycle is formed as a receiver cycle in which a liquid receiver is disposed between the radiator and the expansion valve. The refrigerant in the refrigeration cycle is mixed with refrigerant oil to supply lubrication for the compressor, and a part of the refrigerant oil circulates in the cycle with the refrigerant.

Figure 2:
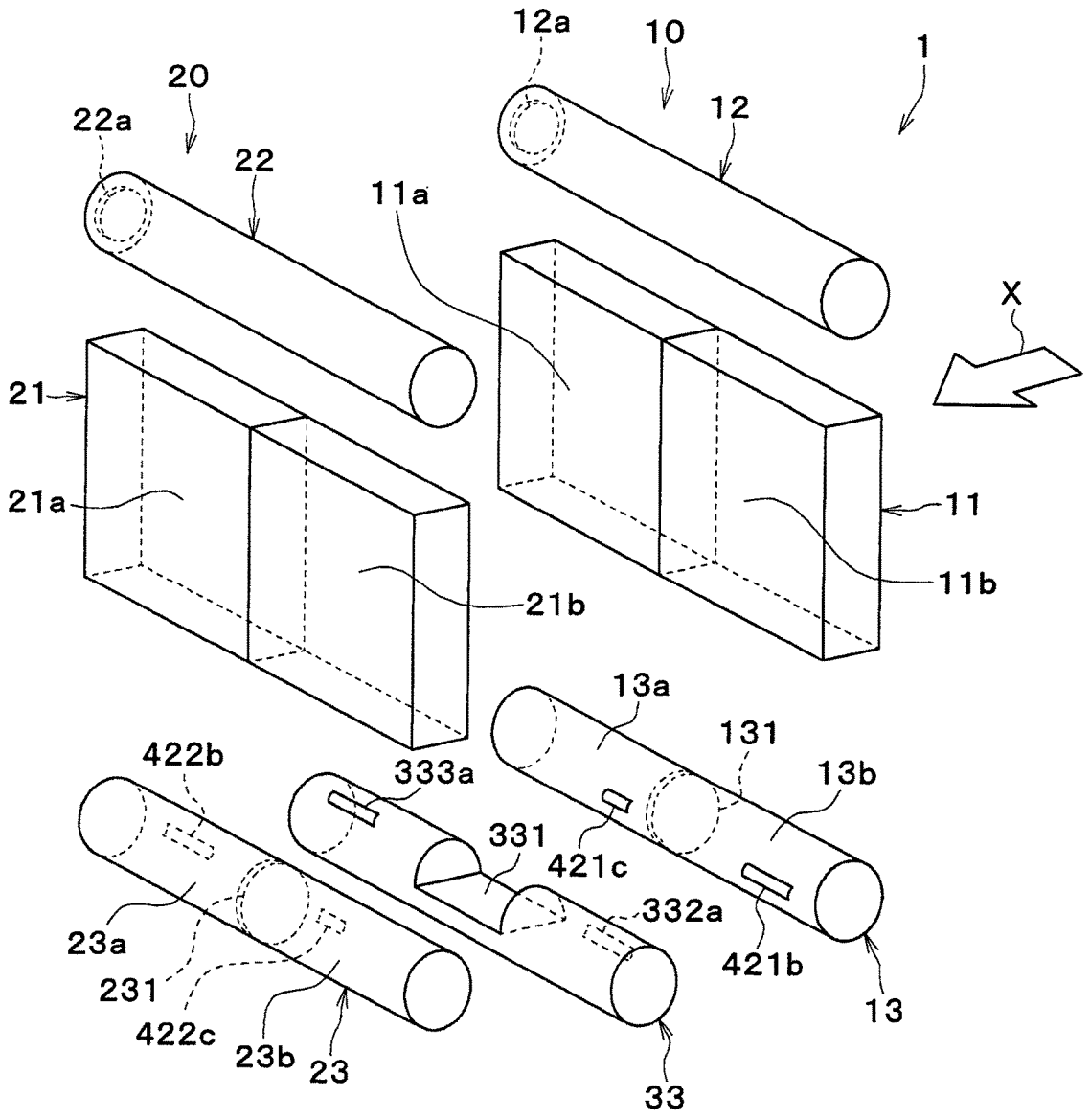
FIG. 2 is a schematic exploded perspective view of the refrigerant evaporator according to the first embodiment.
Figure 3:
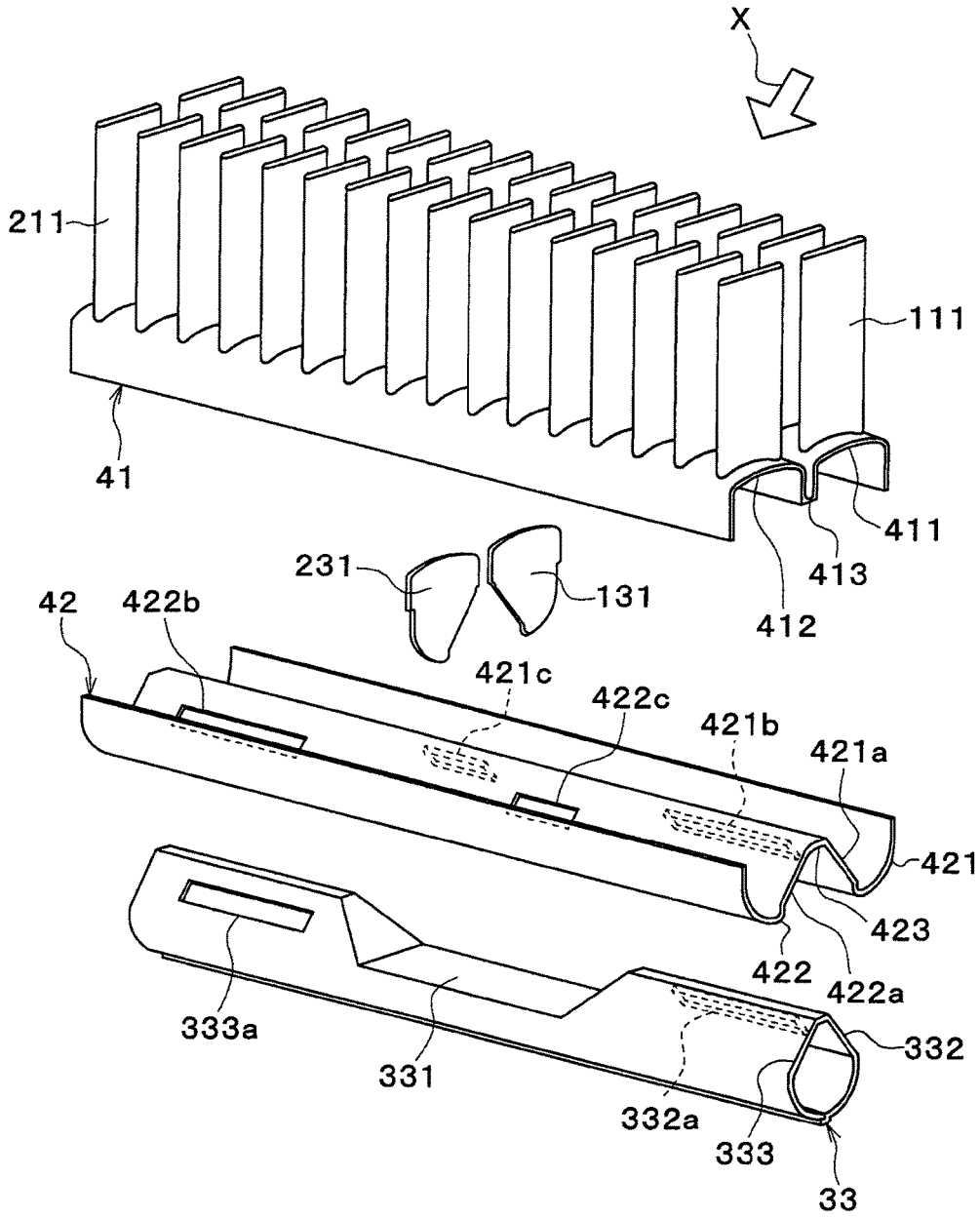
FIG. 3 is an exploded perspective view illustrating a vicinity of an intermediate tank portion of the refrigerant evaporator according to the first embodiment.

As shown in FIG. 1 through FIG. 3, the refrigerant evaporator 1 of the present embodiment includes two evaporation units 10 and 20 disposed in series in a flow direction of blown air (a flow direction of the fluid) X. In the present embodiment, one of the two evaporation units 10 and 20 disposed on a windward side (upstream side) in the flow direction X of blown air is referred to as the windward evaporation unit 10, and the other evaporation unit disposed on a leeward side (downstream side) in the flow direction X of blown air is referred to as the leeward evaporation unit 20. The windward evaporation unit 10 and the leeward evaporation unit 20 of the present embodiment form "a second evaporation unit" and "a first evaporation unit", respectively.

The windward evaporation unit 10 and the leeward evaporation unit 20 are of a same fundamental structure. The windward evaporation unit 10 has a heat-exchanging core portion 11 and a pair of tank portions 12 and 13 disposed, respectively, on upper and lower sides of the heat-exchanging core portion 11. Likewise, the leeward evaporation unit 20 has a heat-exchanging core portion 21 and a pair of tank portions 22 and 23 disposed, respectively, on upper and lower sides of the heat-exchanging core portion 21.

In the present embodiment, the heat-exchanging core portion of the windward evaporation unit 10 is referred to as the windward heat-exchanging core portion 11 and the heat-exchanging core portion of the leeward evaporation unit 20 is referred to as the leeward heat-exchanging core portion 21. In a pair of the tank portions 12 and 13 of the windward evaporation unit 10, the tank portion disposed on the upper side is referred to as the first windward tank portion 12 and the tank portion disposed on the lower side is referred to as the second windward tank portion 13. Likewise, in a pair of the tank portions 22 and 23 of the leeward evaporation unit 20, the tank portion disposed on the upper side is referred to as the first leeward tank portion 22 and the tank portion disposed on the lower side is referred to as the second leeward tank portion 23.

The windward heat-exchanging core portion 11 and the leeward heat-exchanging core portion 21 of the present embodiment are formed of stacked bodies. The windward heat-exchanging core portion 11 is formed by alternately stacking multiple tubes 111 extending in a top-to-bottom direction and fins 112 bonded between the adjacent tubes 111. Likewise, the leeward heat-exchanging core portion 21 is formed by alternately stacking multiple tubes 211 extending in the top-to-bottom directions and fins 112 bonded between the adjacent tubes 211. Hereinafter, a stacking direction of the stacked bodies formed of the multiple tubes 111 and 211 and the fins 112 is referred to as the tube stacking direction.

The windward heat-exchanging core portion 11 has a first windward heat-exchanging core portion 11*a* defined by a part of tube groups of the multiple tubes 111 and a second windward heat-exchanging core portion 11*b* defined by the rest of the tube groups of the multiple tubes 111. The first windward heat-exchanging core portion 11*a* and the second windward heat-exchanging core portion 11*b* of the present embodiment form "a third core portion" and "a fourth core portion", respectively.

In the present embodiment, when the windward heat-exchanging core portion 11 is viewed in the flow direction X of blown air, the first windward heat-exchanging core portion 11*a* is defined by tube groups on a right side in the tube stacking direction while the second windward heat-exchanging core portion 11*b* is defined by the tube groups on a left side in the tube stacking direction.

Also, the leeward heat-exchanging core portion 21 has a first leeward heat-exchanging core portion 21*a* defined by a part of tube groups of the multiple tubes 211 and a second leeward heat-exchanging core portion 21*b* defined by the rest of the tube groups of the multiple tubes 211. The first leeward heat-exchanging core portion 21*a* and the second leeward heat-exchanging core portion 21*b* of the present embodiment form "a first core portion" and "a second core portion", respectively.

In the present embodiment, when the leeward heat-exchanging core portion 21 is viewed in the flow direction X of blown air, the first leeward heat-exchanging core portion 21*a* is defined by tube groups on a right side in the tube stacking direction while the second leeward heat-exchanging core portion 21*b* is defined by the tube groups on a left side in the tube stacking direction. In the present embodiment, when viewed in the flow direction X of blown air, the first windward heat-exchanging core portion 11*a* and the first leeward heat-exchanging core portion 21*a* are disposed to overlap (oppose) with each other, while the second windward heat-exchanging core portion 11*b* and the second leeward heat-exchanging core portion 21*b* are disposed to overlap (oppose) with each other.

Each of the tubes 111, 211 is formed of a flat tube, inside of which a refrigerant passage is defined for the refrigerant to flow and which has a flat sectional shape extending along the flow direction X of blown air.

The tubes 111 of the windward heat-exchanging core portion 11 are connected to the first windward tank portion 12 at one ends (upper ends) in a longitudinal direction and connected to the second windward tank portion 13 at the other ends (lower ends) in the longitudinal direction. Also, the tubes 211 of the leeward heat-exchanging core portion 21 are connected to the first leeward tank portion 22 at one ends (upper ends) in the longitudinal direction and connected to the second leeward tank portion 23 at the other ends (lower ends) in the longitudinal direction.

Each fin 112 is a corrugate fin formed of a thin plate material folded in a wavy shape. The fins 112 are bonded to flat outer surfaces of the respective tubes 111 and 211 and function as heat-exchange facilitating member for increasing a heat-transfer area between the blown air and the refrigerant.

Side plates 113 to reinforce the respective heat-exchanging core portions 11 and 21 are disposed to the respective stacked bodies formed of the tubes 111 and 211 and the fins 112 at both ends in the tube stacking direction. The side plates 113 are bonded to the fins 112 disposed on outermost sides in the tube stacking direction.

The first windward tank portion 12 is formed of a tube-like member which is closed at one end (a left end when viewed in the flow direction X of blown air) and provided with a refrigerant outlet portion 12*a* at the other end (a right end when viewed in the flow direction X of blown air). The refrigerant outlet portion 12*a* is to introduce the refrigerant in the tank to a drawing side of the compressor (not shown). The first windward tank portion 12 has through-holes (not shown) in a bottom portion for the one ends (upper ends) of the respective tubes 111 to be inserted and bonded. In other words, the first windward tank portion 12 is formed in such a manner that an internal space communicates with the respective tubes 111 of the windward heat-exchanging core portion 11, and functions as a refrigerant collection portion that collects the refrigerant from the respective core portions 11*a* and 11*b* of the windward heat-exchanging core portion 11.

The first leeward tank portion 22 is formed of a tube-like member which is closed at one end and provided with a refrigerant inlet portion 22*a* at the other end. The refrigerant inlet portion 22*a* is to introduce the low-pressure refrigerant decompressed at the expansion valve (not shown) into the tank portion. The first leeward tank portion 22 has through-holes (not shown) in a bottom portion for the one ends (upper ends) of the respective tubes 211 to be inserted and bonded. In other words, the first leeward tank portion 22 is formed in such a manner that an internal space communicates with the respective tubes 211 of the leeward heat-exchanging core portion 21, and functions as a refrigerant distribution portion that distributes the refrigerant to the respective core portions 21*a* and 21*b* of the leeward heat-exchanging core portion 21.

The second windward tank portion 13 is formed of a tube-like member closed at both ends. The second windward tank portion 13 has through-holes (not shown) in a ceiling portion for the other ends (lower ends) of the respective tubes 111 to be inserted and bonded. In other words, the second windward tank portion 13 is formed in such a manner that an internal space communicates with the respective tubes 111.

A partition member 131 is disposed inside the second windward tank portion 13 at a center position in the longitudinal direction. The partition member 131 divides the tank internal space to a space with which the respective tubes 111 making up the first windward heat-exchanging core portion 11*a* communicate, and another space with which the respective tubes 111 making up the second windward heat-exchanging core portion 11*b* communicate.

In the interior of the second windward tank portion 13, the space communicating with the respective tubes 111 making up the first windward heat-exchanging core portion 11*a* forms a first refrigerant distribution portion 13*a* that distributes the refrigerant to the first windward heat-exchanging core portion 11*a*, and the space communicating with the respective tubes 111 making up the second windward heat-exchanging core portion 11*b* forms a second refrigerant distribution portion 13*b* that distributes the refrigerant to the second windward heat-exchanging core portion 11*b*.

The second leeward tank portion 23 is formed of a tube-like member closed at both ends. The second leeward tank portion 23 has through-holes (not shown) in a ceiling portion for the other ends (lower ends) of the respective tubes 211 to be inserted and bonded. In other words, the second leeward tank portion 23 is formed in such a manner that an internal space communicates with the respective tubes 211.

A partition member 231 is disposed inside the second leeward tank portion 23 at a center position in the longitudinal direction. The partition member 231 divides the tank internal space to a space with which the respective tubes 211 making up the first leeward heat-exchanging core portion 21*a* communicate, and another space with which the respective tubes 211 making up the second leeward heat-exchanging core portion 21*b* communicate.

In the interior of the second leeward tank portion 23, the space communicating with the respective tubes 211 making up the first leeward heat-exchanging core portion 21*a* forms a first refrigerant collection portion 23*a* that collects the refrigerant from the first leeward heat-exchanging core portion 21*a*, and the space communicating with the respective tubes 211 making up the second leeward heat-exchanging core portion 21*b* forms a second refrigerant collection portion 23*b* that collects the refrigerant from the second leeward heat-exchanging core portion 21*b*.

A detailed configuration of the second windward tank portion 13 and the second leeward tank portion 23 of the present embodiment will now be described.

Figure 4:
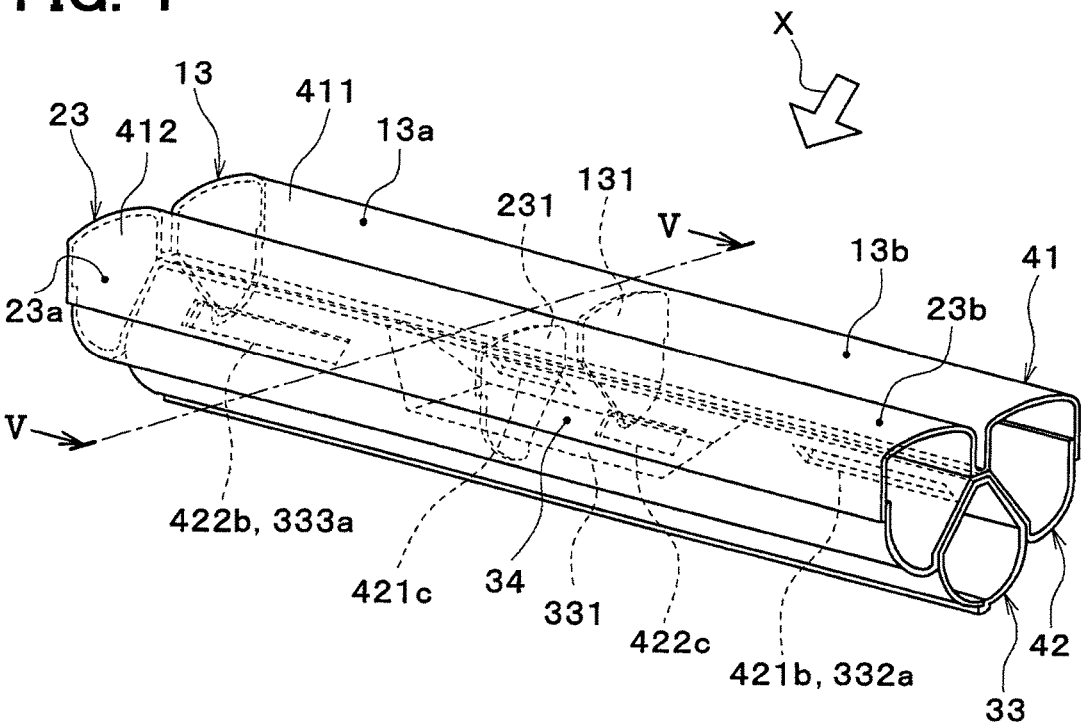
FIG. 4 is a partial transparent perspective view illustrating a second windward tank portion, a second leeward tank portion, and the intermediate tank portion of the refrigerant evaporator according to the first embodiment.
Figure 5:
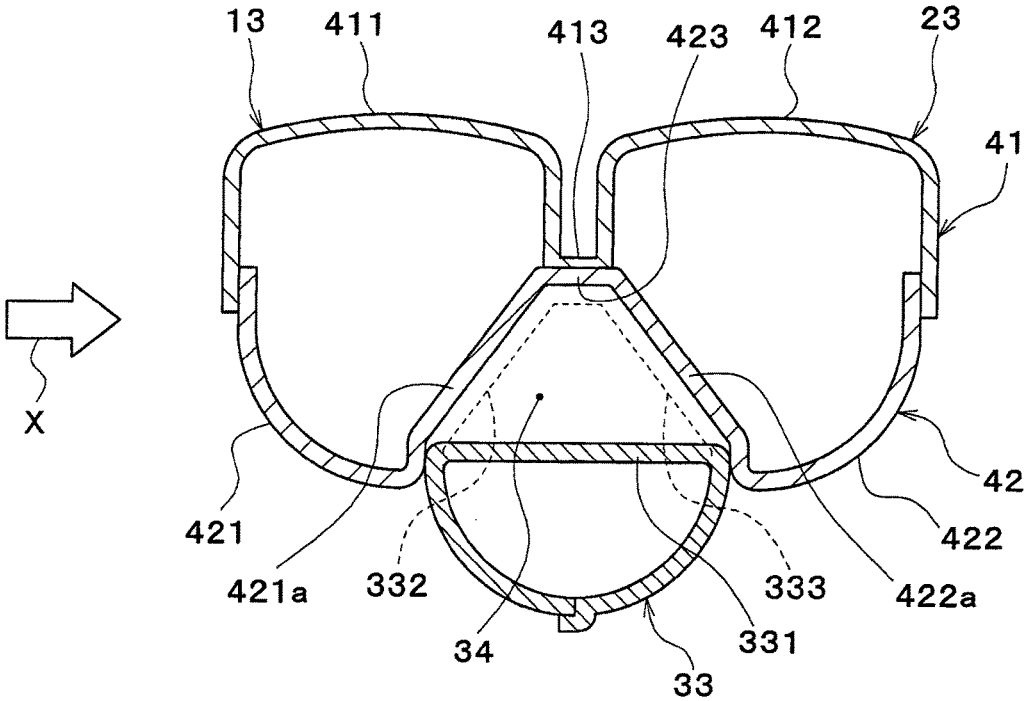
FIG. 5 is a sectional view taken along a line V-V of FIG. 4.

As shown in FIG. 3 through FIG. 5, the second windward tank portion 13 and the second leeward tank portion 23 of the present embodiment are formed in one piece. The second leeward tank portion 23 and the second windward tank portion 13 have a core plate 41 in which the tubes 111 and 211 are inserted and bonded, and a tank main body portion 42 that defines the tank internal space (first refrigerant distribution portion 13*a*, second refrigerant distribution portion 13*b*, first refrigerant collection portion 23*a*, and second refrigerant collection portion 23*b*) together with the core plate 41.

The core plate 41 is formed to have substantially a W-shaped cross section. More specifically, the core plate 41 has a windward tube bonding surface 411 in which to insert and bond the tubes 111 of the windward heat-exchanging core portion 11, and a leeward tube bonding surface 412 in which to insert and bond the tubes 211 of the leeward heat-exchanging core portion 21. Also, the core plate 41 has a core plate convex portion 413 disposed between the two tube bonding surfaces 411 and 412 and protruding more than the two tube bonding surfaces 411 and 412 to an opposite side of the heat-exchanging core portions 11 and 12.

The tank main body portion 42 is formed to have substantially a W-shaped cross section. More specifically, the tank main body portion 42 has a windward tank main body portion 421 that forms the first refrigerant distribution portion 13*a* and the second refrigerant distribution portion 13*b* together with the windward tube bonding surface 411, and a leeward tank main body portion 422 that forms the first refrigerant collection portion 23*a* and the second refrigerant collection portion 23*b* together with the leeward tube bonding surface 412. Also, the tank main body portion 42 has a tank main body convex portion 423 disposed between the two tank main body portions 421 and 422 and protruding more than the two tank main body portions 421 and 422 toward the heat-exchanging core portions 11 and 21.

By bonding the core plate convex portion 413 of the core plate 41 and the tank main body convex portion 423 of the tank main body portion 421, the second windward tank portion 13 and the second leeward tank portion 23 are divided from each other.

By bonding the convex portions 413 and 423 in the state where the partition member 131 is disposed between the windward tube bonding surface 411 and the windward tank main body portion 421, the first refrigerant distribution portion 13*a* and the second refrigerant distribution portion 13*b* are divided from each other. Also, by bonding the convex portions 413 and 423 in the state where the partition member 231 is disposed between the leeward tube bonding surface 412 and the leeward tank main body portion 422, the first refrigerant collection portion 23*a* and the second refrigerant collection portion 23*b* are divided from each other.

An outer surface of an intermediate tank portion 33 to be described below is bonded to an outer surface (lower outer wall of FIG. 3) of the tank main body portion 42 on the opposite side of the heat-exchanging core portions 11 and 21. In the present embodiment, the outer surface of the intermediate tank portion 33 is connected to an outer surface of the tank main body convex portion 423, an outer surface of the windward tank main body portion 421 in a portion connected to the tank main body convex portion 423 and having a linear cross section (hereinafter, referred to as a windward linear portion 421*a*), and an outer surface of the leeward tank main body portion 422 in a portion connected to the tank main body convex portion 423 and having a linear cross section (hereinafter, referred to as a leeward linear portion 422*a*).

The windward linear portion 421*a* has a first windward through-hole 421*b* penetrating from one side to the other side in a portion farther on the opposite side of the refrigerant outlet portion 12*a* with respect to the partition member 131. Also, the windward linear portion 421*a* has a second windward through-hole 421*c* penetrating from one side to the other side in a portion nearer to the refrigerant outlet portion 12*a* with respect to the partition member 131.

The first windward through-hole 421*b* is provided to the windward linear portion 421*a* at the end on the opposite side of the refrigerant outlet portion 12*a*. The second windward through-hole 421*c* is disposed to the windward linear portion 421*a* in the vicinity of the partition member 131. In the present embodiment, an opening area of the first windward through-hole 421*b* is larger than an opening area of the second windward through-hole 421*c*.

The leeward linear portion 422*a* has a first leeward through-hole 422*b* penetrating from one side to the other side in a portion nearer to the refrigerant inlet portion 22*a* with respect to the partition member 231. Also, the leeward linear portion 422*a* has a second leeward through-hole 422*c* penetrating from one side to the other side in a portion farther on the opposite side of the refrigerant inlet portion 22*a* with respect to the partition member 231.

The first leeward through-hole 422*b* is provided to the windward linear portion 422*a* at the end adjacent to the refrigerant inlet portion 22*a*. The second leeward through-hole 422*c* is disposed to the leeward linear portion 422*a* in the vicinity of the partition member 231. In the present embodiment, an opening area of the first leeward through-hole 422*b* is larger than an opening area of the second leeward through-hole 422*c*.

The intermediate tank portion 33 is formed of a tube-like member, within which a refrigerant channel to pass the refrigerant is defined. In the present embodiment, the intermediate tank portion 33 is provided by bending a single metal plate in the shape of a tube.

The intermediate tank portion 33 has a recess portion 331 which is an outer wall opposing the tank main body portion 42 recessed inward of the intermediate tank portion 33 (downward in FIG. 3). In other words, the recess portion 331 is formed by depressing the outer wall of the intermediate tank portion 33 opposing both the second leeward tank portion 23 and the second windward tank portion 13 inward of the intermediate tank portion 33.

The recess portion 331 is positioned in the vicinity of a region corresponding to the partition members 131 and 231 (in the present embodiment, a center portion in the tube stacking direction) in the intermediate tank portion 33.

By providing the recess portion 331, a tank external refrigerant space 34 to which the refrigerant flows in and out is defined by the outer wall of the tank main body portion 42 and the outer wall of the recess portion 331 of the intermediate tank portion 33. More specifically, the tank external refrigerant space 34 is a refrigerant space outside the tank, and is defined by the outer wall of the recess portion 331 of the intermediate tank portion 33, the outer wall of the tank main body convex portion 423, the outer wall of the windward linear portion 421*a*, and the outer wall of the leeward linear portion 422*a*.

A region of the intermediate tank portion 33 bonded to the windward linear portion 421*a* of the tank main body portion 42 is referred to as a windward wall surface 332, and a region bonded to the leeward linear portion 422*a* of the tank main body portion 42 is referred to as a leeward wall surface 333.

The windward wall surface 332 of the intermediate tank portion has a first through-hole 332*a* penetrating from one side to the other side in a region corresponding to the first windward through-hole 421*b*. The first through-hole 332*a* is formed in the same shape as the first windward through-hole 421*b*.

The leeward wall surface 333 of the intermediate tank portion has a second through-hole 333*a* penetrating from one side to the other side in a region corresponding to the first leeward through-hole 422*b*. The second through-hole 333*a* is formed in the same shape as the first leeward through-hole 422*b*.

Figure 6:
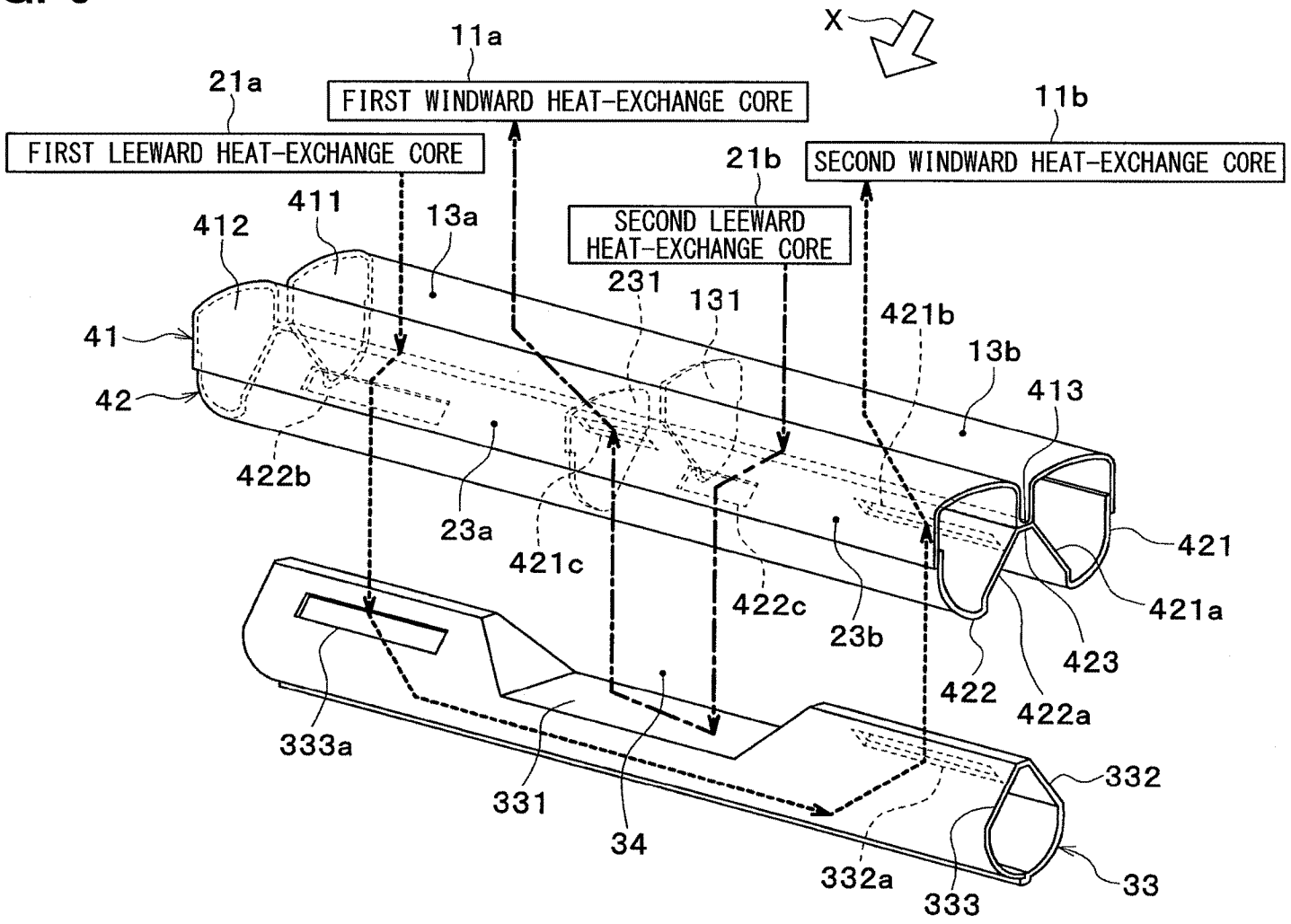
FIG. 6 is a view to describe flows of refrigerant in the refrigerant evaporator according to the first embodiment.

As has been described above, by providing the second windward tank portion 13, the second leeward tank portion 23, and the intermediate tank portion 33, as is indicated by a dashed arrow of FIG. 6, the refrigerant that has flowed down the first leeward heat-exchanging core portion 21*a* flows into the first refrigerant collection portion 23*a* of the second leeward tank portion 23. The refrigerant that has flowed into the first refrigerant collection portion 23*a* flows into the intermediate tank portion 33 via the first leeward through-hole 422*b* and the second through-hole 333*a* of the intermediate tank portion.

The refrigerant that has flowed into the intermediate tank portion 33 flows into the second refrigerant distribution portion 13*b* of the second windward tank portion 13 via the first through-hole 332*a* of the intermediate tank portion and the first windward through-hole 421*b*. The refrigerant that has flowed into the second refrigerant distribution portion 13*b* flows up the second windward heat-exchanging core portion 11*b* of the windward heat-exchanging core portion 11.

On the other hand, as is indicated by an alternate long and short dashed arrow of FIG. 6, the refrigerant that has flowed down the second leeward heat-exchanging core portion 21*b* flows into the second refrigerant collection portion 23*b* of the second leeward tank portion 23. The refrigerant that has flowed into the second refrigerant collection portion 23*b* flows into the tank external refrigerant space 34 via the second leeward through-hole 422*c*.

The refrigerant that has flowed into the tank external refrigerant space 34 flows into the first refrigerant distribution portion 13*a* of the second windward tank portion 13 via the second windward through-hole 421*c*. The refrigerant that has flowed into the first refrigerant distribution portion 13*a* flows up the first windward heat-exchanging core portion 11*a* of the windward heat-exchanging core portion 11.

Hence, in the present embodiment, the first leeward through-hole 422*b* corresponds to "a first through-hole" and the second through-hole 333*a* of the intermediate tank portion corresponds to "a second through-hole". Also, the first windward through-hole 421*b* corresponds to "a third through-hole" and the first through-hole 332*a* of the intermediate tank portion corresponds to "a fourth through-hole".

Owing to the intermediate tank portion 33 and the tank external refrigerant space 34 configured as above, the refrigerant in the first refrigerant collection portion 23*a* of the second leeward tank portion 23 is introduced to the second refrigerant distribution portion 13*b* of the second windward tank portion 13 while the refrigerant in the second refrigerant collection portion 23*b* of the second leeward tank portion 23 is introduced to the first refrigerant distribution portion 13*a* of the second windward tank portion 13. In short, the intermediate tank portion 33 and the tank external refrigerant space 34 are configured so as to interchange flows of the refrigerant in the core width direction in the respective heat-exchanging core portions 11 and 21.

Hence, in the present embodiment, the intermediate tank portion 33 corresponds to "a first communication portion" and the tank external refrigerant space 34 corresponds to "a second communication portion".

According to the refrigerant evaporator 1 of the present embodiment described above, a first refrigerant channel (see the dashed arrow of FIG. 6) that introduces the refrigerant from the first leeward heat-exchanging core portion 21*a* to the second windward heat-exchanging core portion 11*b* is formed by providing the intermediate tank portion 33. Also, a second refrigerant channel (see the alternate long and short dashed arrow of FIG. 6) that introduces the refrigerant from the second leeward heat-exchanging core portion 21*b* to the first windward heat-exchanging core portion 11*a* is formed by defining the tank external refrigerant space 34 with the outer wall of the second leeward tank portion 23, the outer wall of the second windward tank portion 13, and the outer wall of the intermediate tank portion 33.

Consequently, the first refrigerant channel and the second refrigerant channel can be formed as refrigerant channels independent of each other. Flows of the refrigerant can be thus interchanged in the width direction (tube stacking direction) of the heat-exchanging core portions 11*a*, 11*b*, 21*a*, 21*b* in a reliable manner.

Second Embodiment

A second embodiment will be described according to FIG. 7 and FIG. 8. In comparison with the first embodiment above, the second embodiment is different in that groove portions 35 communicating with outside are provided to a connection surface of a second windward tank portion 13 and an intermediate tank portion 33, and a connection surface of a second leeward tank portion 23 and the intermediate tank portion 33.

Figure 7:
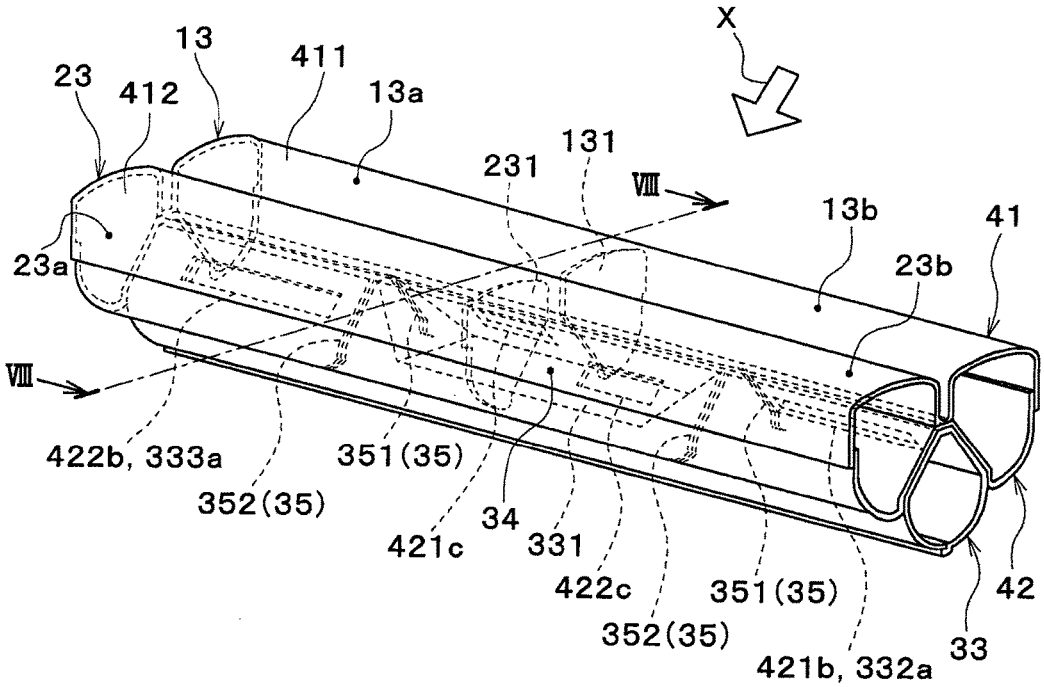
FIG. 7 is a partial transparent perspective view illustrating a second windward tank portion, a second leeward tank portion, and an intermediate tank portion of a refrigerant evaporator according to a second embodiment.
Figure 8:
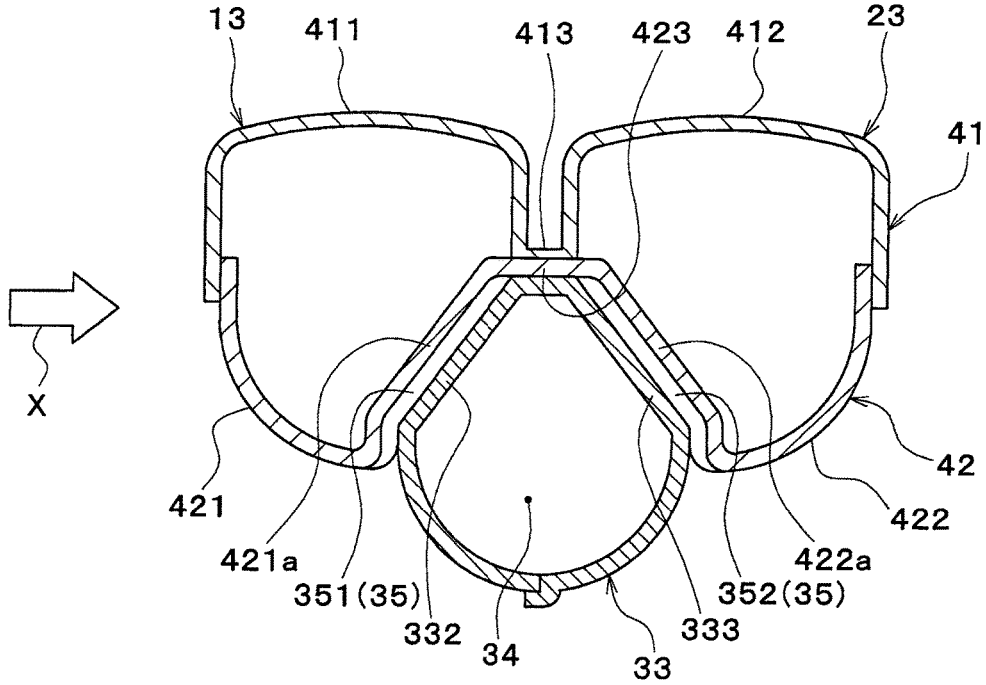
FIG. 8 is a sectional view taken along a line VIII-VIII of FIG. 7.

As shown in FIG. 7 and FIG. 8, four groove portions 35 extending in a direction orthogonal to a longitudinal direction (tube stacking direction) of a tank main body portion 42 are provided to a windward linear portion 421*a* and a leeward linear portion 422*a* of the tank main body portion 42. Of the groove portions 35, the groove portions 35 provided to a windward wall surface 332 are referred to as windward groove portions 351 and the groove portions 35 provided to a leeward wall surface 333 are referred to as leeward groove portions 352.

In the present embodiment, two windward groove portions 351 and two leeward groove portions 352 are provided. When a refrigerant evaporator 1 is viewed in the flow direction X of blown air, the windward groove portions 351 and the leeward groove portions 352 are disposed at positions to overlap with each other.

One of the two windward groove portions 351 is disposed between a first windward through-hole 421*b* (first through-hole 332*a* of intermediate tank portion) and a recess portion 331. One of the two leeward groove portions 352 is disposed between a first leeward through-hole 422*b* (second through-hole 333*a* of intermediate tank portion) and the recess portion 331.

In the event of poor brazing between an outer wall of the tank main body portion 42 and an outer wall of the intermediate tank portion 33, the first windward through-hole 421*b* (first through-hole 332*a* of intermediate tank portion) or/and the first leeward through-hole 422*b* (second through-hole 333*a* of intermediate tank portion) may possibly communicate with a tank external refrigerant space 34. In such a case, the refrigerant in the first refrigerant channel flowing in and out of the intermediate tank portion 33 and the refrigerant in the second refrigerant channel flowing in and out of the tank external refrigerant space 34 may be mixed with each other and the refrigerant channels may no longer be independent of each other.

Normally, poor brazing is detected by adopting an inspection method, according to which the refrigerant evaporator 1 is filled with an inspection fluid at a predetermined pressure to detect leakage caused by poor brazing by checking whether the inspection fluid flows outside. However, in the case of poor brazing that allows communication between the first or second windward through-hole 421*b*, 422*b* and the tank external refrigerant space 34 as above, poor brazing is undetectable because the inspection fluid does not flow outside during the leakage inspection.

On the contrary, according to the present embodiment, by providing the groove portions 35 communicating with outside to the connection surface of the second windward tank portion 13 and the intermediate tank portion 33 and the connection surface of the second leeward tank portion 23 and the intermediate tank portion 33, the inspection fluid flows outside via the groove portions 35 during the leakage inspection in the event of poor brazing causing a communication between the first or second windward through-hole 421*b*, 422*b* and the tank external refrigerant space 34 as above. Hence, poor brazing can be readily detected.

Other Embodiment

It should be appreciated that the present disclosure is not limited to the embodiments above and can be modified in various manners within the scope and sprit of the present disclosure as follows.

The intermediate tank portion 33 is provided by bending a single metal plate in the shape of a tube in the above embodiment. However, the configuration of the intermediate tank portion 33 is not limited to the above case.

Figure 9:
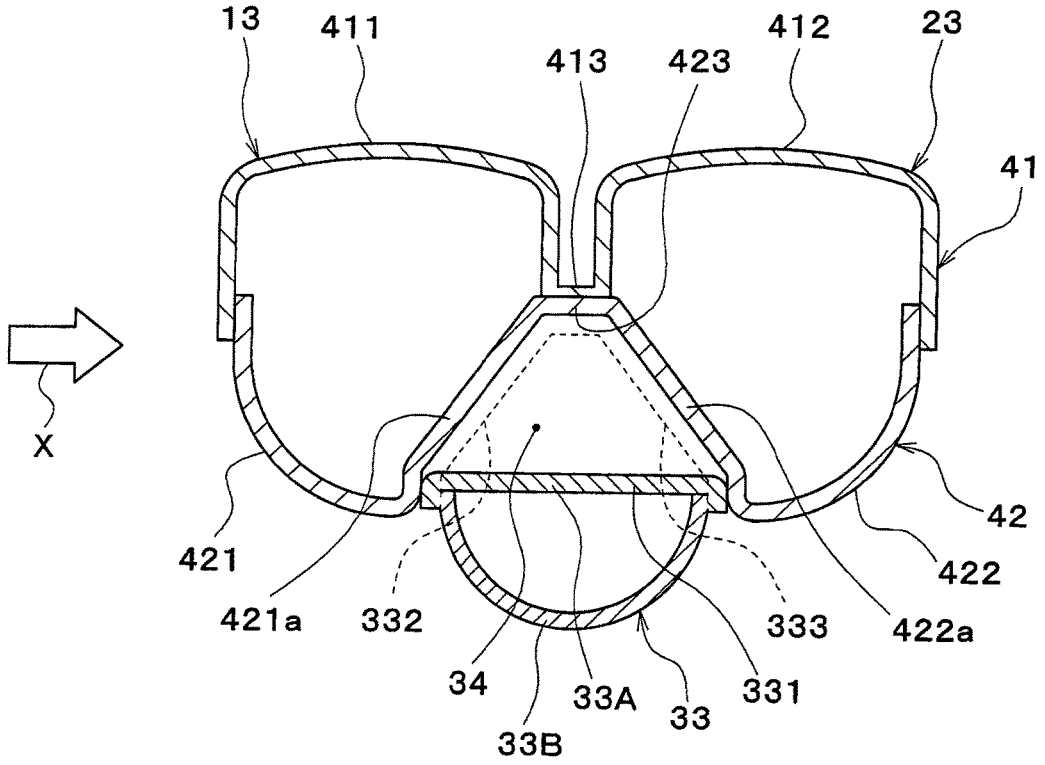
FIG. 9 is a sectional view illustrating a second windward tank portion, a second leeward tank portion, and an intermediate tank portion of a refrigerant evaporator according to other embodiment.

For example, as shown in FIG. 9, the intermediate tank portion 33 may be formed by combining and bonding a first tank member 33A having a semi-cylindrical and a second tank member 33B to cover the first tank member 33A.

The second windward tank portion 13 and the second leeward tank portion 23 are formed into one piece in the above embodiment. However, the present disclosure is not limited to the above case and the second windward tank portion 13 and the second leeward tank portion 23 may be provided separately.

When the refrigerant evaporator 1 is viewed in the flow direction X of blown air, the first windward heat-exchanging core portion 11*a* and the first leeward heat-exchanging core portion 21*a* are disposed to fully overlap, and the second windward heat-exchanging core portion 11*b* and the second leeward heat-exchanging core portion 21*b* are disposed to fully overlap in the above embodiment. However, the present disclosure is not limited to the above case. It may be configured in such a manner that when the refrigerant evaporator 1 is viewed in the flow direction X of blown air, the first windward heat-exchanging core portion 11*a* and the first leeward heat-exchanging core portion 21*a* are disposed to partially overlap, and the second windward heat-exchanging core portion 11*b* and the second leeward heat-exchanging core portion 21*b* are disposed to partially overlap.

It is preferable to dispose the windward evaporation unit 10 upstream of the leeward evaporation unit 20 in the flow direction X of blown air in the refrigerant evaporator 1. However, the present disclosure is not limited to the above configuration and the windward evaporation unit 10 may be disposed downstream of the leeward evaporation unit 20 in the flow direction X of blown air.

The heat-exchanging core portion 11, 21 is defined by the multiple tubes 111, 211 and the fins 112 in the above embodiment. However, the present disclosure is not limited to the above case and the heat-exchanging core portion 11, 21 may be made up of only the multiple tubes 111, 211. In a case where the heat-exchanging core portion 11, 21 is made up of the multiple tubes 111, 211 and the fins 112, the fins 112 are not limited to corrugate fins and plate fins may be adopted instead.

The refrigerant evaporator 1 is applied to the refrigerating cycle in the air conditioner for a vehicle in the above embodiment. However, the present disclosure is not limited to the above case and the refrigerant evaporator 1 may be applied to a refrigerating cycle used in, for example, a water heater instead.

The groove portions 35 are provided to the tank main body portion 42 in the second embodiment. However, the present disclosure is not limited to the above case and the groove portions 35 may be provided to the intermediate tank portion 33 instead.

The groove portions 35 are provided to both of the connection surface of the second windward tank portion 13 and the intermediate tank portion 33 and the connection surface of the second leeward tank portion 23 and the intermediate tank portion 33 in the second embodiment. However, the present disclosure is not limited to the above case. The groove portions 35 may be provided to one of the connection surface of the second windward tank portion 13 and the intermediate tank portion 33 and the connection surface of the second leeward tank portion 23 and the intermediate tank portion 33.

What is claimed is:

1. A refrigerant evaporator that exchanges heat between fluid flowing outside to be cooled and refrigerant, comprising a first evaporation unit and a second evaporation unit disposed in series in a flow direction of the fluid, wherein:

each of the first evaporation unit and the second evaporation unit has a heat-exchanging core portion in which a plurality of tubes are stacked, the refrigerant flowing through the plurality of tubes, and a pair of tank portions connected to both ends of the plurality of tubes to collect or distribute the refrigerant flowing through the plurality of tubes;

the heat-exchanging core portion of the first evaporation unit has a first core portion defined by a part of the plurality of tubes and a second core portion defined by a rest of the plurality of tubes;

the heat-exchanging core portion of the second evaporation unit has a third core portion defined by a part of the plurality of tubes opposing at least a part of the first core portion in the flow direction of the fluid and a fourth core portion defined by a part of the plurality of tubes opposing at least a part of the second core portion in the flow direction of the fluid;

of the pair of tank portions of the first evaporation unit, one tank portion includes a first refrigerant collection portion to collect the refrigerant from the first core portion and a second refrigerant collection portion to collect the refrigerant from the second core portion;

of the pair of tank portions of the second evaporation unit, one tank portion includes a first refrigerant distribution portion to distribute the refrigerant to the third core portion and a second refrigerant distribution portion to distribute the refrigerant to the fourth core portion;

the first evaporation unit and the second evaporation unit are coupled via a first communication portion that introduces the refrigerant in the first refrigerant collection portion to the second refrigerant distribution portion and a second communication portion that introduces the refrigerant in the second refrigerant collection portion to the first refrigerant distribution portion;

an intermediate tank portion through which refrigerant flows is connected to an outer surface of the one tank portion of the first evaporation unit and an outer surface of the one tank portion of the second evaporation unit;

a tank external refrigerant space through which refrigerant flows is defined by an outer wall of the one tank portion of the first evaporation unit, an outer wall of the one tank portion of the second evaporation unit, and an outer wall of the intermediate tank portion; and the intermediate tank portion defines the first communication portion and the tank external refrigerant space defines the second communication portion.

2. The refrigerant evaporator according to claim 1, wherein:

the intermediate tank portion has a recess portion recessed inward of the intermediate tank portion from an outer wall of the intermediate tank portion opposing both of the one tank portion of the first evaporation unit and the one tank portion of the second evaporation unit; and the tank external refrigerant space is defined by the outer wall of the one tank portion of the first evaporation unit, the outer wall of the one tank portion of the second evaporation unit, and an outer wall of the recess portion of the intermediate tank portion.

3. The refrigerant evaporator according to claim 2, wherein:

the one tank portion of the first evaporation unit has a first through-hole in a region opposing the intermediate tank portion;

the intermediate tank portion has a second through-hole in a region corresponding to the first through-hole;

an interior of the one tank portion of the first evaporation unit and an interior of the intermediate tank portion communicate with each other via the first through-hole and the second through-hole;

the one tank portion of the second evaporation unit has a third through-hole in a region opposing the intermediate tank portion;

the intermediate tank portion has a fourth through-hole in a region corresponding to the third through-hole;

an interior of the one tank portion of the second evaporation unit and the interior of the intermediate tank portion communicate with each other via the third through-hole and the fourth through-hole; and a groove portion communicating with outside is provided to at least one of a region between the recess portion and the first through-hole or the second through-hole in a connection surface of the one tank portion of the first evaporation unit and the intermediate tank portion, and a region between the recess portion and the third through-hole or the fourth through-hole in a connection surface of the one tank portion of the second evaporation unit and the intermediate tank portion.

4. The refrigerant evaporator according to claim 1, wherein refrigerant contacts at least one of the outer walls during refrigerant flow through the tank external refrigerant space.

5. The refrigerant evaporator according to claim 1, wherein:

refrigerant contacts the outer wall of the one tank portion of the first evaporation unit, the outer wall of the one tank portion of the second evaporation unit and the outer wall of the intermediate tank portion during refrigerant flow through the tank external refrigerant space.

6. The refrigerant evaporator according to claim 1, wherein the intermediate tank portion has a single outer wall.

7. The refrigerant evaporator according to claim 1, wherein the tank external refrigerant space is generally triangularly shaped in cross section.

8. The refrigerant evaporator according to claim 7, wherein the recess portion of the intermediate tank portion forms a base of the generally triangularly shaped tank external refrigerant space.

9. The refrigerant evaporator according to claim 1, wherein the intermediate tank portion is located below the one tank portion of the first evaporation unit and the one tank portion of the second evaporation unit.

10. A refrigerant evaporator that exchanges heat between fluid flowing outside to be cooled and refrigerant, comprising a first evaporation unit and a second evaporation unit disposed in series in a flow direction of the fluid, wherein:

each of the first evaporation unit and the second evaporation unit has a heat-exchanging core portion in which a plurality of tubes are stacked, the refrigerant flowing through the plurality of tubes, and a pair of tank portions connected to both ends of the plurality of tubes to collect or distribute the refrigerant flowing through the plurality of tubes;

the heat-exchanging core portion of the first evaporation unit has a first core portion defined by a part of the plurality of tubes and a second core portion defined by a rest of the plurality of tubes;

the heat-exchanging core portion of the second evaporation unit has a third core portion defined by a part of the plurality of tubes opposing at least a part of the first core portion in the flow direction of the fluid and a fourth core portion defined by a part of the plurality of tubes opposing at least a part of the second core portion in the flow direction of the fluid;

of the pair of tank portions of the first evaporation unit, one tank portion includes a first refrigerant collection portion to collect the refrigerant from the first core portion and a second refrigerant collection portion to collect the refrigerant from the second core portion;

of the pair of tank portions of the second evaporation unit, one tank portion includes a first refrigerant distribution portion to distribute the refrigerant to the third core portion and a second refrigerant distribution portion to distribute the refrigerant to the fourth core portion;

the first evaporation unit and the second evaporation unit are coupled via a first communication portion that introduces the refrigerant in the first refrigerant collection portion to the second refrigerant distribution portion and a second communication portion that introduces the refrigerant in the second refrigerant collection portion to the first refrigerant distribution portion;

an intermediate tank portion through which refrigerant flows is connected to an outer surface of the one tank portion of the first evaporation unit and an outer surface of the one tank portion of the second evaporation unit;

a tank external refrigerant space through which refrigerant flows is defined by an outer wall of the one tank portion of the first evaporation unit, an outer wall of the one tank portion of the second evaporation unit, and an outer wall of the intermediate tank portion, wherein refrigerant contacts the outer walls during refrigerant flow through the tank external refrigerant space; and the intermediate tank portion defines the first communication portion and the tank external refrigerant space defines the second communication portion.

11. The refrigerant evaporator according to claim 10, wherein:

refrigerant contacts the outer wall of the one tank portion of the first evaporation unit, the outer wall of the one tank portion of the second evaporation unit and the outer wall of the intermediate tank portion during refrigerant flow through the tank external refrigerant space.

12. The refrigerant evaporator according to claim 10, wherein the intermediate tank portion has a single outer wall.

13. The refrigerant evaporator according to claim 10, wherein the tank external refrigerant space is generally triangularly shaped in cross section.

14. The refrigerant evaporator according to claim 13, wherein the recess portion of the intermediate tank portion forms a base of the generally triangularly shaped tank external refrigerant space.

15. The refrigerant evaporator according to claim 10, wherein the intermediate tank portion is located below the one tank portion of the first evaporation unit and the one tank portion of the second evaporation unit.

* * * * *